United States Patent [19]

Ichimura et al.

[11] Patent Number: 4,887,974

[45] Date of Patent: Dec. 19, 1989

[54] CONNECTOR

[75] Inventors: Yoshiaki Ichimura, Tokyo; Katumi Takegawa, Higashiyamato; Yoshinori Mizusawa, Tokyo; Mitsuo Komoto, Tokyo; Shoji Umesato, Tokyo, Japan

[73] Assignees: Japan Aviation Electronics Industry, Limited; NEC Corporation, both of Tokyo, Japan

[21] Appl. No.: 302,515

[22] Filed: Jan. 27, 1989

[30] Foreign Application Priority Data

Feb. 3, 1988 [JP] Japan ..... 63-13384
Feb. 3, 1988 [JP] Japan ..... 63-13387

[51] Int. Cl.[4] ..... H01R 13/62
[52] U.S. Cl. ..... 439/259; 439/296
[58] Field of Search ..... 439/259, 260, 261, 262, 439/263, 266, 288, 296, 264

[56] References Cited

U.S. PATENT DOCUMENTS

| | | | |
|---|---|---|---|
| 3,315,212 | 4/1967 | Peterson | 439/264 |
| 3,594,698 | 7/1971 | Anhalt | 439/261 |
| 4,082,399 | 4/1978 | Barkhuff | 439/264 |
| 4,290,661 | 9/1981 | Burns | 439/262 |
| 4,468,072 | 8/1984 | Sadigh-Behzadi | 439/296 X |
| 4,496,205 | 1/1985 | Christensen et al. | 439/288 X |
| 4,512,621 | 4/1985 | Bethurum | 439/296 X |

OTHER PUBLICATIONS

"Zero Insertion Force Module Socket" IBM Tech. Bulletin, vol. 17, No. 10, Mar. 1975.
"Pinless Module Connector System" Research Disclosure No. 286, Feb. 1988.

*Primary Examiner*—William Briggs
*Attorney, Agent, or Firm*—Pollock, Vande Sande and Priddy

[57] ABSTRACT

A top housing, which has formed therein arrays of first housing chambers and first pin insertion holes respectively communicating therewith, and a bottom housing, which has formed therein arrays of second housing chambers and second pin insertion holes respectively communicating therewith, are assembled together so that the corresponding first and second housing chambers intercommunicate. A socket contactor is housed across the corresponding first and second housing chambers. The top and bottom housings are held together by a frame so that they are slidable relative to each other. Terminal pins of an IC are inserted into the first housing chambers through the first pin insertion holes and pin conductors of a printed board are inserted into the second housing chambers through the second pin insertion holes. By sliding the top and bottom housings relative to each other, each socket contactor is bent, and by its spring force, the socket contactor is urged against the terminal pin and the pin conductor.

11 Claims, 8 Drawing Sheets

CONNECTOR

BACKGROUND OF THE INVENTION

The present invention relates to a connector for interconnecting two kinds of pin contactors, for example, terminal pins of an IC and pin conductors attached to a printed board.

As a kind of IC socket for detachably mounting an IC on a printed board, there has been proposed a connector of the type that after each terminal pin of the IC is inserted in its axial direction, a sliding member is slid in a direction perpendicular to the axial direction of the terminal pin, urging the terminal pin into contact with a socket contactor with a predetermined contact pressure. FIGS. 1A, 1B, 2A and 2B show examples of such types of connectors heretofore employed.

In FIGS. 1A and 1B, a cantilever type socket contactor 2 planted on a base insulator 1 is inserted into a contact chamber 4 formed in a cover insulator 3 and a terminal pin 9 of an IC 8 is inserted into the contact chamber 4 through a pin insertion hole 5 made in the cover insulator 3. Then, the cover insulator 3 is slid to the right relative to the base insulator 1 in FIG. 1A so that the terminal pin 9 is urged by the inner side wall of the contact chamber 4 against the socket contactor 2, bending it as depicted in FIG. 1B. Thus, the terminal pin 9 is pressed into contact with the socket contactor 2 with a predetermined contact pressure.

In FIGS. 2A and 2B, a socket contactor 6, which comprises a pair of opposed spring pieces **6*a* and 6*b* of different lengths, is planted on the base insulator 1 with the spring pieces 6*a* and 6*b* disposed in a contact chamber 7 formed in the base insulator 1. The shorter spring piece 6*a* has its tip engaged with a groove 7*a* cut in the ceiling of the contact chamber 7 and the longer spring piece 6*b* has its tip engaged with a groove 3*b* cut in the underside of the cover insulator 3. The cover insulator 3 is slid to the right relative to the base insulator 1 in FIG. 2B so that the spring pieces 6*a* and 6*b* are pulled apart as shown in FIG. 2A, and the terminal pin 9 of the IC 8 is inserted between the spring pieces 6*a* and 6*b* in the contact chamber 7 of the base insulator 1 through the pin insertion hole 5 of the cover insulator 3. Then, the cover insulator 3 is returned to its initial position, where the terminal pin 9 held between the spring pieces 6*a* and 6*b* is in contact with the socket contactor 6** with a predetermined contact pressure.

In operability and mechanical strength, however, the conventional connectors shown in FIGS. 1 and 2 are not suitable for use with a PGA (Pin Grid Array) type LSI having hundreds of pins, because they need a driving force equal in magnitude to the total amount of contact pressures for individual terminal pins 9 for sliding the cover insulator 3 to bring the terminal pins 9 into contact with the socket contactors 2 and for sliding the cover insulator 3 to pull the spring pieces **6*a* and 6*b* apart, respectively. In addition, either of the conventional connectors is troublesome in assembling because it involves fixing the socket contactor 2 or 6 to the base insulator 1**, and consequently, it is not suitable for use with an element having a large number of terminals with a high density.

SUMMARY OF THE INVENTION

An object of the present invention is to provide a connector in which terminal pins inserted thereinto in their axial direction are each connected to a pin conductor through a socket contactor by sliding a sliding member in a direction perpendicular to the axial direction of the terminal pin and in which the terminal pin can be connected, by small force, to the pin conductor through the socket contactor with a predetermined contact pressure.

Another object of the present invention is to provide a connector which is suitable for use with an element having a large number of pins.

Yet another object of the present invention is to provide a connector which affords the reduction of a space of a contact block for each terminal pin and hence permits the formation of a large number of contact blocks with a high density but is easy to assemble.

The connector of the present invention includes a top housing, a bottom housing, and socket contactors. The top housing has arrays of first pin insertion holes made in its upper panel and first housing chambers formed therein, each first housing chamber extending from the corresponding first pin insertion hole to the lower panel of the top housing. The first housing chambers each having a first wall surface for close contact with a terminal pin inserted thereinto through the corresponding first pin insertion hole and a second wall surface opposite the first wall surface.

The bottom housing is disposed on the underside of the top housing. The bottom housing has arrays of second pin insertion holes made in its lower panel and second housing chambers formed therein, each second housing chamber being open to the corresponding first housing chamber of the top housing and communicating with the corresponding second pin insertion hole. The second housing chambers each have a first wall surface for close contact with a pin conductor inserted thereinto through the corresponding second pin insertion hole and a second wall surface opposite the first wall surface.

The socket contactors are each formed by a strip of metal and housed in the connector, with its upper end portion positioned in the first housing chamber of the top housing and its lower end portion positioned in the second housing chamber of the bottom housing.

According to an aspect of the present invention, the pin conductor is inserted into the first housing chamber of the top housing across the second housing chamber of the bottom housing from its second pin insertion hole, and the terminal pin is inserted into the first housing chamber of the top housing from its first pin insertion hole. One end portion of the socket contactor has a bent portion lying between the terminal pin and the pin conductor and being longer than the distance therebetween. After the pin conductors and the terminal pins have thus been inserted into the connector, the bottom housing is slid relative to the top housing, by which the other end portion of each socket contactor is urged by the second wall surface of the second housing chamber of the bottom housing and the bent portion of the socket contactor is turned in a direction of further pushing the terminal pin and the pin conductor apart and is urged against them, establishing electrical connection therebetween.

According to another aspect of the present invention, the pin conductor is inserted into the second housing chamber of the bottom housing from its second pin insertion hole and the terminal pin is inserted into the first housing chamber of the top housing from its first pin insertion hole. The terminal pin is positioned at one side of the socket contactor in the first housing chamber and the pin conductor is positioned at the other side of the socket contactor in the second housing chamber. After the pin conductors and the terminal pins have thus been inserted into the connector, the top housing is slid relative to the bottom housing, by which the socket contactor presses at its one end portion the terminal pin against the first wall surface of the first housing chamber of the top housing and at the other end portion the pin conductor against the first wall surface of the second housing chamber of the bottom housing, establishing electrical connection between the terminal pin and the conductor pin.

With the connector of the present invention constructed as mentioned above, the pin conductors and the terminal pins can be inserted into the connector without requiring any particular force. When sliding the bottom housing relative to the top housing after inserting the pin conductors and the terminal pins into the connector, the socket contactors are bent, by which the terminal pins and the pin conductors are interconnected through the socket contactors, respectively.

DESCRIPTION OF THE PREFERRED EMBODIMENTS

FIGS. 3A through 3F illustrate the principal part of an embodiment of the connector according to the present invention, which is shown to form an IC socket. The connector of the present invention is provided with a top housing 10, a bottom housing 20 and socket contactors 30.

Figure 1A:
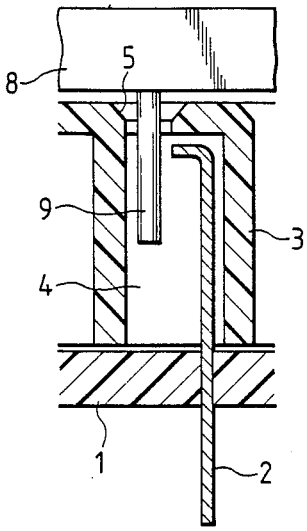
FIG. 1A PRIOR ART
FIGS. 1A and 1B are sectional views showing an example of a conventional connector.
Figure 1B:
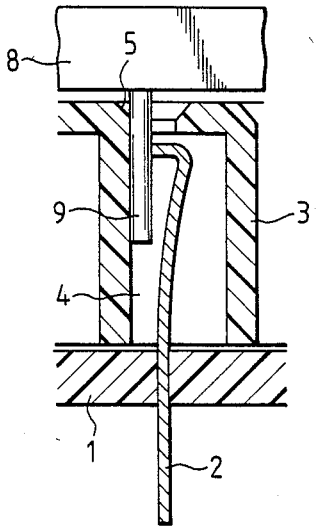
FIG. 1B PRIOR ART
Figure 2A:
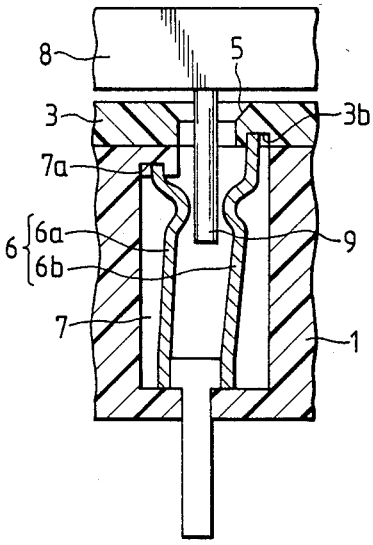
FIG. 2A PRIOR ART
FIGS. 2A and 2B are sectional views showing another example of a conventional connector.
Figure 2B:
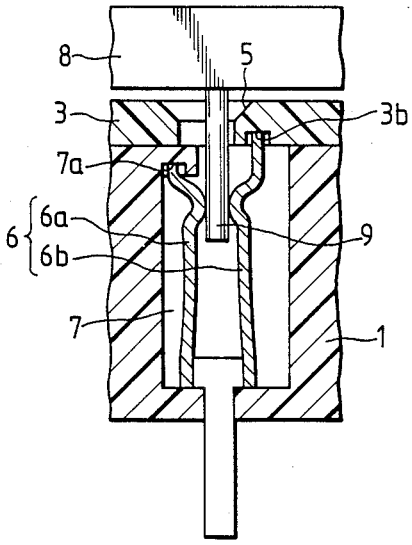
FIG. 2B PRIOR ART
Figure 3A:
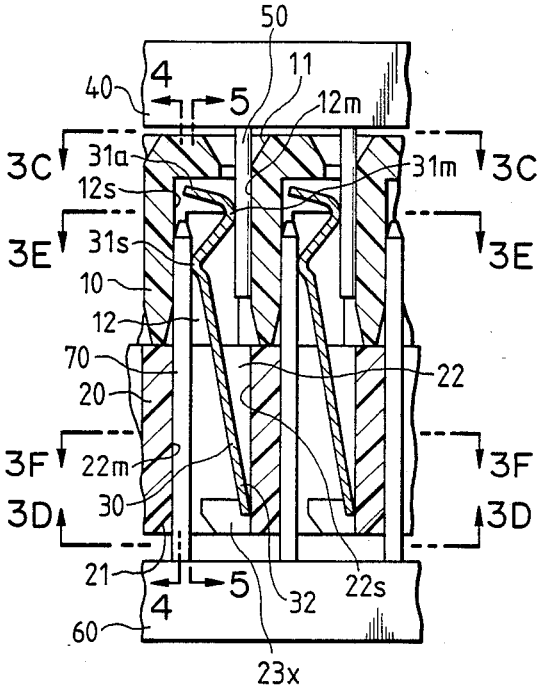
FIGS. 3A and 3B are sectional views illustrating the principal part of an embodiment of the connector of the present invention.
Figure 3B:
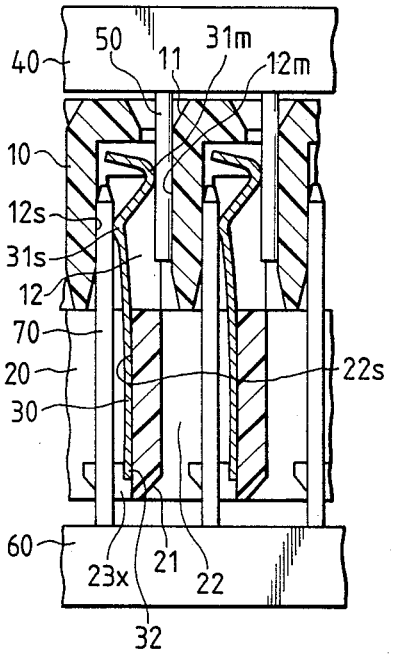
Figure 3C:
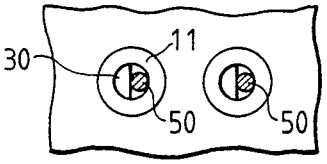
FIGS. 3C to 3F are sectional views taken on the lines 3C—3C, 3D—3D, 3E—3E and 3F—3F in FIG. 3A, respectively.
Figure 3D:
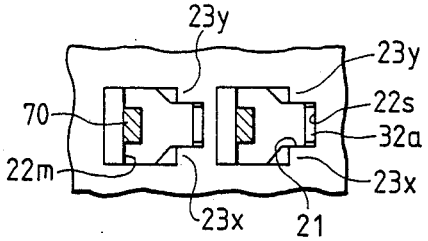
Figure 3E:
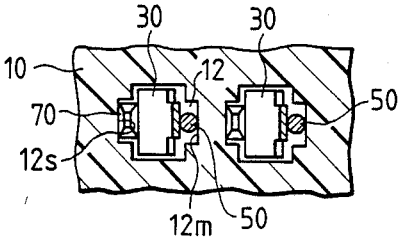
Figure 3F:
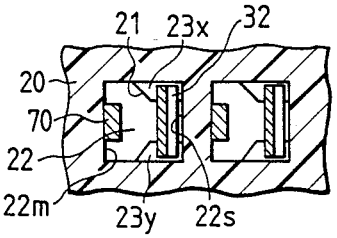
Figure 4:
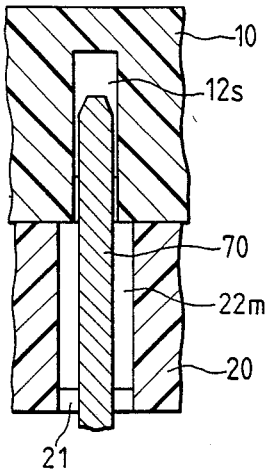
FIG. 4 is a sectional view taken on the line 4—4 in FIG. 3A.

The top housing 10 has in its top such circular pin insertion holes 11 as shown in FIG. 3C and has contact chambers 12 which communicate with the pin insertion holes 11, respectively, and extend down to the bottom of the top housing 10. As shown in FIG. 3E, the contact chambers 12 are each substantially square in section and have a first wall surface **12*m* along which a terminal pin is inserted into the contact chamber 12 through the pin insertion hole 11, i.e. a terminal pin 50 of an LSI 40 in this example, and a second wall surface 12*s* which is opposite the first wall surface 12*m* and along which a pin conductor 70 mounted on a printed board 60 is inserted into the contact chamber 12 from the underside of the top housing 10. The widths of the first and second wall surfaces 12*m* and 12*s* of the contact chamber 12 are smaller than the width of the central portion of the contact chamber 12 as will be seen from FIGS. 3E and 4. The pin insertion holes 11 and the contact chambers 12 are provided in arrays corresponding to those of the terminal pins 50 of the LSI 40**.

Figure 5:
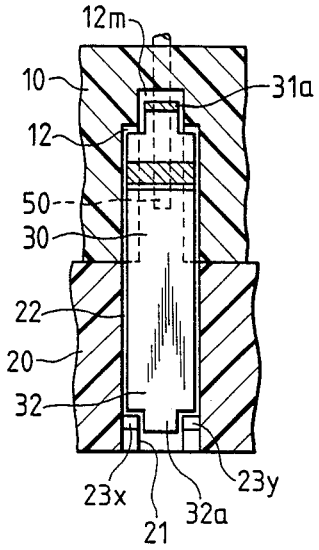
FIG. 5 is a sectional view taken on the line 5—5 in FIG. 3A.

The bottom housing 20 is mounted on the underside of the top housing 10. The bottom housing 20 has in its bottom pin insertion holes 21 and has housing chambers 22 which extend down to the pin insertion holes 21, respectively. Each housing chamber 22 has a first wall surface **22*m* along which the pin conductor 70 is inserted into the housing chamber 22 through the pin insertion hole 21, and a second wall surface 22*s* opposite the first one 22*m*. The widths of the first and second wall surfaces 22*m* and 22*s* of the housing chamber 22 are equal to the width of the central portion of the contact chamber 12 as will be seen from FIG. 5. The pin insertion hole 21 is made extending from the position of the first wall surface 22*m* to the position of the second wall surface 22*m* so that the bottom housing 20 is slidable relative to the pin conductor 70 inserted into the housing chamber 22 through the hole 21, within a certain range in the direction in which the first and second wall surfaces 22*m* and 22*s* of the housing chamber 22 face each other, as is evident from FIG. 3D. The width of the portion of the pin insertion hole 21 on the side of second wall surface 22*s* in the direction perpendicular to the direction in which the first and second wall surfaces face each other is smaller than the width of the portion of the pin insertion hole 21 on the side of the first wall surface 22*m*. On both sides of the narrow portion of the pin insertion hole 21 in the direction of its width there are provided stepped portions 23*x* and 23*y* which protrude into the housing chamber 22 and form engaging portions. The pin insertion holes 21, the housing chambers 22 and the stepped portions 23*x* and 23*y* are provided in the same arrays as those of the pin conductors 70 on the printed board 60, that is, in the same arrays as those of the terminal pins 50 of the LSI 40**.

Figure 6:
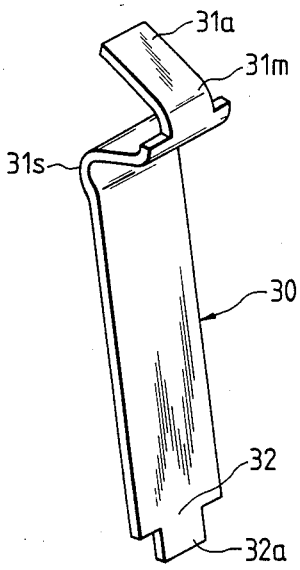
FIG. 6 is a perspective view of a socket contactor used in the embodiment depicted in FIGS. 3A and 3B.

As shown in FIG. 6, each socket contactor 30 is formed by a strip of metal, one end portion of which is bent into a substantially S-letter shape and includes a first contact portion 31*m* near its tip and a second contact portion 31*s* extending in a direction reverse from the first contact portion 31*m* and contiguous to the body of the socket contactor 30. The width of the body of the socket contactor 30 is selected corresponding to the width of the central portion of the housing chamber 22, but the widths of the first contact portion 31*m*, the tip end portion 31*a* of the S-shaped portion and the tip end portion 32*a* of the other end portion 32 are small corresponding to the above-mentioned widths of the upper portion of the contact chamber 12 and the portion of the pin insertion hole 21 on the side of its second wall surface 22*s*. The width of the afore-mentioned wide portion of the contact chamber 12 in the direction in which the first and second wall surfaces 12*m* and 12*s* face each other is somewhat greater than the thickness of the socket contactor 30 from the first contact portion 31*m* to the second contact portion 31*s*. The distance between the first and second wall surfaces 12*m* and 12*s* of the contact chamber 12 is selected to be the sum of the above-said thickness of the socket contactor 30 and the diameters of the terminal pin 50 and the pin conductor 70.

The socket contactor 30 is housed extending across the contact chamber 12 of the top housing 10 and the housing chamber 22 of the bottom housing 20, with the narrow tip end portion 31*a* of one end portion of the socket contactor 30 fitted in the narrow upper portion of the contact chamber 12 and the wide end portion of the above-said one end portion fitted in the wide portion of the contact chamber 12 so that the first and second contact portions 31*m* and 31*s* of the socket contactor 30 face the first and second wall surfaces 12*m* and 12*s* of the contact chamber 12, respectively. The narrow tip end portion 32*a* of the other end portion 32 of the socket contactor 30 is held between the stepped portions 23*x* and 23*y* at the side of the second wall surface 22*s* of the housing chamber 22, with the other end portion 32 locked to them. In this instance, a large number of socket contactors 30 still unsevered after being pressed are respectively inserted into the contact chambers 12 and the housing chambers 22 through the pin insertion holes 21 and then they are severed into individual elements. Each socket contactor 30 can be set in position simply by inserting the narrow tip end portion 32*a* of the lower end portion 32 between the stepped portions 23*x* and 23*y* and pressing the lower end portion 32 toward the second wall surface 22*s* of the housing chamber 22. Consequently, the connector of the present invention is easy of assembling. Moreover, since the broad portion of the upper end portion of the socket contactor 30 is fitted in the broad portion of the contact chamber 12 and since the lower end portion 32 is locked to the stepped portions 23*x* and 23*y* at the side of the scond wall surface 22*s* of the housing chamber 22, the socket contactor 30 will not become unsteady nor will it come out of the pin insertion hole 21 after assembling.

FIGS. 7A through 7D illustrate the whole structure of an example of the connector of the above construction according to the present invention.

The top and bottom housings 10 and 20 are fitted in a frame 80. The top housing 10 is slidable relative to the bottom housing 20 in the horizontal direction in FIGS. 7A, 7B and 7D. Of course, the socket contactors 30 have been inserted into the contact and housing chambers 12 and 22 of the top and bottom housings 10 and 20.

In one end portion 81 of the frame 80 there is made, at a position opposite one end face 10*c* of the top housing 10, a slot 82 which extends from one side 80*a* of the frame 80 to the other side 80*b* thereof. The slot 82, as viewed in cross-section, is substantially semi-circular, open at the side of the end face 10*c* of the top housing 10 but the opposite end portions of the slot 82 are circularly-sectioned in the both sides 80*a* and 80*b* of the frame 80. A cam 91 semi-circular in cross-section is received in the slot 82. The cam 91 has at its one end a flange 92 for preventing the cam 91 from coming out of the slot 82. The other end portion of the cam 91 projects out of the frame 80 and carries a lever 92 for rotating the cam 91.

Figure 7A:
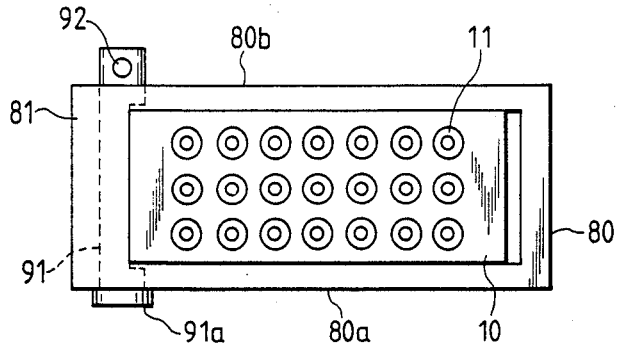
FIGS. 7A to 7D are diagrams, for explaining the entire structure of the connector depicted in FIGS. 3A and 3B.
Figure 7B:
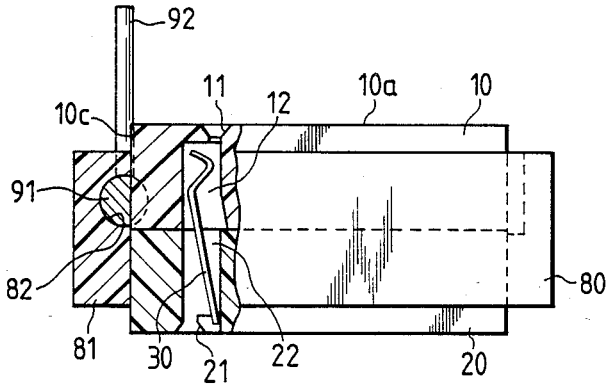
Figure 7C:
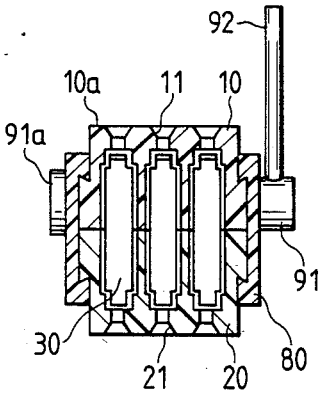

When the lever 92 is held vertical to the top surface 10*a* of the top housing 10 as shown in FIGS. 7A, 7B and 7C, the cam 91 lies in its entirety in the slot 82, the top housing 10 is biased by the spring force of the socket contactors 30 to a position where one end face 10*c* of the top housing 10 is in contact with one end portion 81 of the frame 80, and the top and bottom housings 10 and 20 are held in the state shown in FIG. 3A. As referred to previously, the connector in such a state is mounted on the printed board 60 and its pin conductors 70 are inserted into the bottom housing 20 and then the terminal pins 50 of the LSI 40 are inserted into the top housing 10, as depicted in FIG. 3A.

Figure 7D:
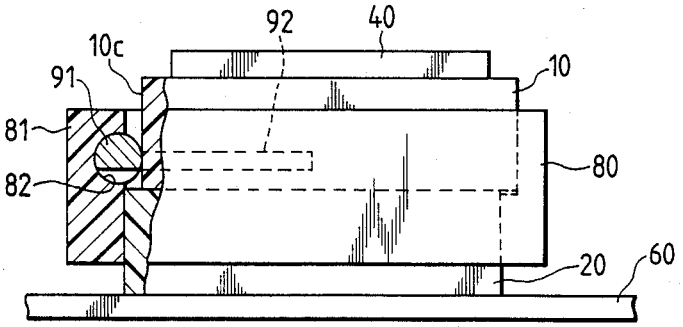

Next, the lever 92 is turned through 90 degrees to a position where it lies flat in parallel to the top 10*a* of the top housing 10 as depicted in FIG. 7D. By this, the cam 91 is rotated through 90 degrees while shifting the top housing 10 to the right in FIG. 7D against the spring force of the socket contactors 30. As a result, the top and bottom housings 10 and 20 are brought into such a condition as shown in FIG. 3B in which the socket contactors 30 are each bent, connecting therethrough the terminal pin 50 to the pin conductor 70 and hence mounting the LSI 40 on the printed board 60.

When turning the lever 92 through 90 degrees in the reverse direction, the cam 91 returns in its entirety into the slot 82 and the top housing 10 slides to the left in FIG. 7D by virtue of the spring force of the socket contactors 30; namely, the top and bottom housing 10 and 20 and the socket contactors 30 are brought back into the state shown in FIG. 3A. Then it is possible to pull out the terminal pins 50 of the LSI 40 from the top housing 10 and hence disassemble the LSI 40 from the printed board 60. No particular force is needed for pulling out the terminal pins 50 from the top housing 10.

With the connector of the above structure, the LSI 40 is mounted on the printed board 60 in the following manner. The connector with the bottom housing 20 held in the position shown in FIG. 3A relative to the top housing is pressed against the printed board 60 so that its pin conductors 70 enter into the contact chambers 12 of the top housing 10 through the housing chambers 22 of the bottom housing 20 from its pin insertion holes 21, and then the LSI 40 is urged against the connector from above, inserting the terminal pins 50 into the contact chambers 12 of the top housing 10 from its pin insertion holes 11. At this time, as shown in FIG. 3A, each pin conductor 70 is guided along the first wall surface 22*m* of the housing chamber 22 and the second wall surface 12*s* of the contact chamber 12 and finally held between the second wall surface 12*s* and the second contact portion 31*s* of the socket contactor 30. On the other hand, each terminal pin 50 is guided along the first wall surface 12*m* of the contact chamber 12 and held between it and the first contact portion 31*m* of the socket contactor 30. Thus, the pin conductors 70 and the terminal pins 50 can easily be inserted into the connector with no particular force needed.

Thereafter, by turning the lever 92 through 90 degrees, the bottom housing 20 is caused to slide relative to the top housing 10, the printed board 60, the pin conductors 70, the LSI 40 and the terminal pins 50 in the direction from the second wall surface 22*s* to the first wall surface 22*m* of the housing chamber 2 of the bottom housing 20, that is, to the left in FIG. 3A. By this, as depicted in FIG. 3B, the second wall surface 22*s* of the housing chamber 22 presses and bends the lower end portion 32 of each socket contactor 30 toward the pin conductor 70, the second contact portion 31*s* of the socket contactor 30 urges the pin conductor 70 against the second wall surface 12*s* of the contact chamber 12, and the first contact portion 31*m* of the socket contactor 30 urges the terminal pin 50 against the first wall surface 12*m* of the contact chamber 12, connecting the terminal pin 50 to the pin conductor 70 via the socket contactor 30. In this way, the LSI 40 is mounted on the printed board 60.

Figure 8:
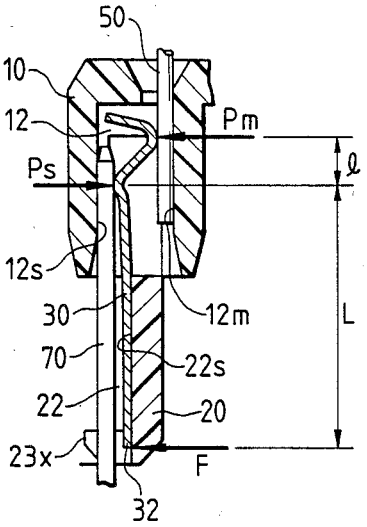
FIG. 8 is a diagram, for explaining the relationship between contact pressure and driving force in the embodiment shown in FIGS. 3A and 3B.

In FIG. 8, F represents the force which is applied to each socket contactor 30 by the second wall surface 22*s* of the bottom housing 20, that is, the driving force for the bottom housing 20 for each terminal pin 50, Pm represents the force which is applied to the socket contactor 30 by the first wall surface 12*m* of the top housing 10, that is, the force of contact of the terminal 50 with the socket contactor 30, Ps represents the force which is applied to the socket contactor 30 by the second wall surface 12*s* of the top housng 10, that is, the force of contact of the pin conductor 50 with the socket contactor 30, l represents the distance from the point of contact between the socket contactor 30 and the terminal pin 50 to the point of contact between the socket contactor 30 and the pin conductor 70, and L represents the distance from the point of contact between the socket contactor 30 and the pin conductor 70 to the lower end 32 of the socket contactor 30. In such an instance, due to equilibrium of the moment about the contact point of the socket contactor 30 with the pin conductor 70, it follows that $$F \cdot L = Pm \cdot l \quad (1)$$

Further, since $$Ps = F + Pm \quad (2)$$

$$F = \frac{l}{L} Pm < Ps \quad (3)$$

Since the socket contactor 30 has the first and second contact portions 31*m* and 31*s* on its upper end portion and since $l << L$, $F << Pm < Ps$, and consequently, only small driving force is needed by which the terminal pin 50 can be contacted with the pin conductor 70 through the socket contactor 70 with a predetermined pressure.

Turning the lever 92 through 90 degrees in the reverse direction, the bottom housing 20 slides to the right in FIG. 3B due to the restoring force of the socket contactors 30 and returns to its initial position shown in FIG. 3A. In this state, the terminal pins 50 of the LSI 40 are pulled out of the top housing 20, that is, the LSI 40 is disassembled from the printed board 60. No particular force is needed for pulling out the terminal pins 50.

In FIGS. 9A to 9D there is shown the principal part of another embodiment of the connector according to the present invention as being applied to an IC socket.

The connector of this embodiment also has the top and bottom housing 10 and 20 and the socket contactors 30.

The top housing 10 has the pin insertion holes 11 made in its top 10*a* and the contact chambers 12 which extend from the pin insertion holes 11 to the bottom 10*b* of the top housing 10. The contact chambers 12 each have the first wall surface 12*m* for close contact with a terminal pin inserted into the contact chamber 12 through the pin insertion hole 11, that is, the terminal pin 50 of the LSI 40 in this example, and the second wall surface 12*s* opposite the first wall surface 12*m*. The width of the upper portion of the contact chamber 12 near the first wall surface 12*m* is small in the direction perpendicular to the direction in which the first and second wall surfaces 12*m* and 12*s* face each other, as compared with the width of the socket contactor 30. On both sides of the second wall surface 12*s* there are provided wall surfaces 12*x* and 12*y* opposite thereto. The pin insertion holes 11 and the contact chambers 12 are provided in the same arrays of the terminal pins 50 of the LSI 40.

The bottom housing 20 is disposed on the underside 10*b* of the top housing 10. The bottom housing 20 has the pin insertion holes 21 made in its bottom 20*a* and the contact chambers 22 which extend from the pin insertion holes 21 to the top 20*b* of the bottom housing 20. The contact chambers each have the first wall surface 22*m* for close contact with the pin conductor inserted into the contact chamber 22 through the pin insertion hole 22, that is, the pin conductor 70 of the printed board 70 in this example, and the second wall surface 22*s* which faces the first wall surface 22*m* in a direction opposite to that in which second wall surface 12*s* faces the first wall surface 12*m* in the contact chamber 12 of the top housing 10. The width of the lower portion of the contact chamber 22 near the first wall surface 22*m* is smaller than the width of the socket contactor 30 in the direction perpendicular to that in which the first and second wall surfaces 22*m* and 22*s* face each other. On both sides of the second wall surface 22*s* there are provided wall surfaces 22*x* and 22*y* opposite thereto. The pin insertion holes 21 and the contact chambers 22 are provided in the same arrays as those of the pin conductors 70 planted on the printed board 60, that is, in the same arrays as those of the terminal pins 50 of the LSI 40.

Figure 10:
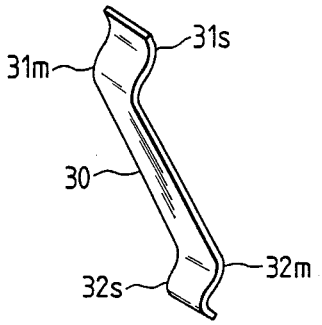
FIG. 10 is a perspective view of a socket contactor 30 used in the connector depicted in FIGS. 9A and 9B.

As shown in FIG. 10, the socket contactor 30 is formed by a strip of metal, which has its one end portion bent into an S-letter shape to form a wall surface contact portion 31*s* near the bent end and a pin contact portion 31*m* a little further to the center of the contactor 30 than the contact portion 31*s* and has the other end portion similarly bent into an S-letter shape but in a direction reverse from that of the above-mentioned one to form a wall surface contact portion 32*s* near the bent end portion and a pin contact portion 32*m* a little further to the center of the contactor 30 than the contact portion 32*s*.

When placed in the connector, the socket contactor 30 has its upper half portion housed in the contact chamber 12 of the top housing 10, with the wall surface contact portion 31*s* held between the wall surfaces 12*x* and 12*y* and the second wall surface 12*s* and the pin contact portion 31*m* held opposite the first wall surface 12*m*. The lower half portion of the socket contactor 30 is housed in the contact chamber 22 of the bottom housing 20, with the wall surface contact portion 32*s* held between the wall surfaces 22*x* and 22*y* and the second wall surface 22*s* and the pin contact portion 32*m* held opposite the first wall surface 22*m*.

Figure 9C:
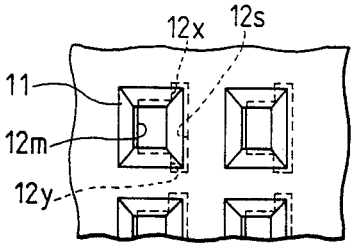
FIG. 9C is a plan view including pin insertion holes 11 in FIG. 9A.
Figure 9A:
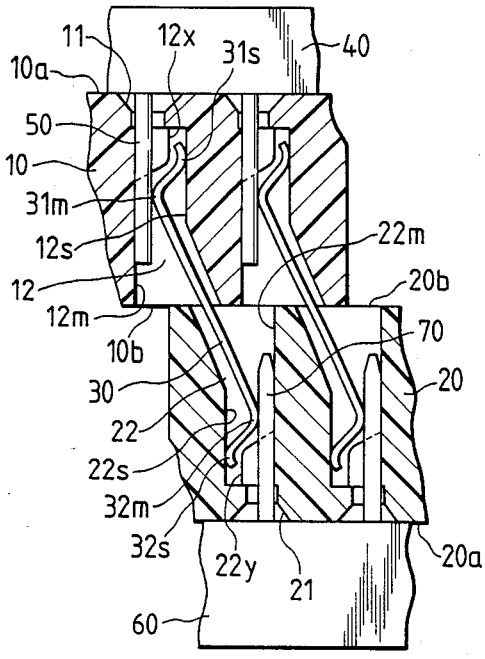
FIGS. 9A and 9B are sectional views illustrating the principal part of another embodiment of the present invention.

The connector, which is formed by the top and bottom housings 10 and 20 assembled together and the socket contactors 30 housed therein as mentioned above, is mounted on the printed board 60 with the pin conductors 70 planted thereon. As is the case with the embodiment described previously, the connector is pressed against the printed board 60 so that each pin conductor 70 is inserted into the contact chamber 22 of the bottom housing 20 through its pin insertion hole 21, and the LSI 40 is pressed against the connector from above, inserting each terminal pin 50 into the contact chamber 12 of the top housing 10 through its pin insertion hole 11 as depicted in FIG. 9A. At this time, the pin conductor 70 is guided along the first wall surface 22*m* of the contact chamber 22 and held between it and the pin contact portion 32*m* of the lower end portion of the socket contactor 30, and the terminal pin 50 is similarly guided along the first wall surface 12*m* of the contact chamber 12 and held between it and the pin contact portion 31*m* of upper end portion of the socket contactor 30. Thus, the pin conductors 70 and the terminal pins 50 can easily be inserted into the connector without any particular force.

Figure 9B:
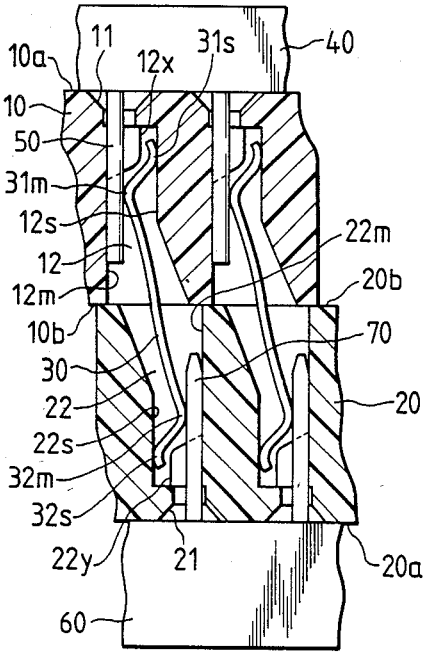
Figure 9D:
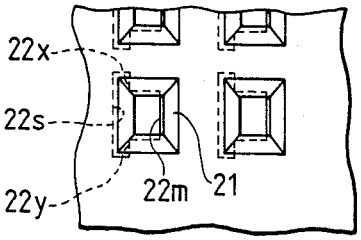
FIG. 9D is a plan view including pin insertion holes 21 in FIG. 9A.

After the insertion of the pin conductors 70 and the terminal pins 50 into the connector, the top housing 10 is slid relative to the bottom housing 20 in the direction from the first wall surface 12*m* to the second wall surface 12*s* in the contact chamber 12 of the top housing 10. By this, each socket contactor 30 is tilted or pushed clockwise relative to its initial position before the top housing 10 is slid, as shown in FIG. 9B. The wall surface contact portion 31*s* of the upper end portion of the socket contactor 30 contacts the second wall surface 12*s* of the upper contact chamber 12, the wall surface contact portion 32*s* of the lower end portion of the socket contactor 30 contacts the second wall surface 22*s* of the lower contact chamber 22, the pin contact portion 31*m* of the upper end portion of the socket contactor 30 urges the terminal pin 50 against the first wall surface 12*m* of the upper contact chamber 12, and the pin contact portion 32*m* of the lower end portion of the socket contactor 30 urges the pin conductor 70 against the first wall surface 22*m* of the lower contact chamber 22. In this way, the terminal pin 50 is connected to the pin conductor 70 via the socket contactor 30. In other words, the LSI 40 is thus mounted on the printed board 60.

Figure 11:
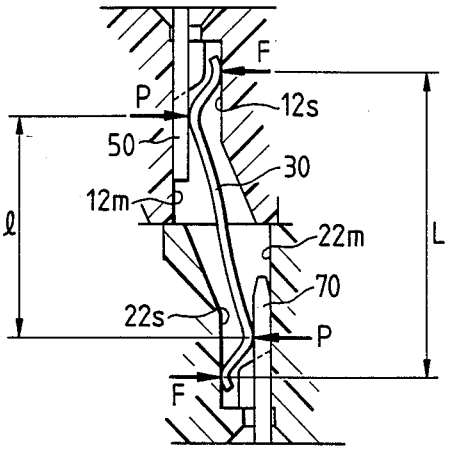
FIG. 11 is a diagram, for explaining the relationship between contact pressure and driving force in the embodiment depicted in FIGS. 9A and 9B.

In FIG. 11, P represents the force which is applied to the socket contactor 30 from the first wall surface 12*m*, that is, the force of contact of the terminal pin 50 with the socket contactor 30, and the force which is applied to the socket contactor 30 from the first wall surface 22*m*, that is, the force of contact of the pin conductor 70 with the socket contactor 30, F represents the force which is applied to the socket contactor 30 from the second wall surfaces 12*s* and 22*s*, l represents the distance between the points of contact of the socket contactor 30 with the terminal pin 50 and the pin conductor 70, and L represents the distance between the points of contact of the socket contactor 30 with the second wall surfaces 12*s* and 22*s*. In this instance, due to a balance between the moments about the points of contact of the socket contactor 30 with the terminal pin 50 and the pin conductor 70, it follows that $$P \cdot l = F \cdot L \tag{4}$$

Consequently, the force W for each socket contactor 30 becomes as follows:

$$W = P - F + \left(1 - \frac{l}{L}\right)P \tag{5}$$

By setting l/L to a value close to 1, the force W can be made appreciably small relative to the contact force P, and the terminal pin 50 can be connected, by a small force, via the socket contactor 30 to the pin conductor 70 with a predetermined contact pressure.

Since the terminal pin 50 is guided along the first wall surface 12*m* and pressed against the first wall surface 12*m* by the socket contactor 30 as described above, the terminal pin 50 will not be bent when it is inserted into the connector. The same is true of the pin conductor 70.

Figure 12A:
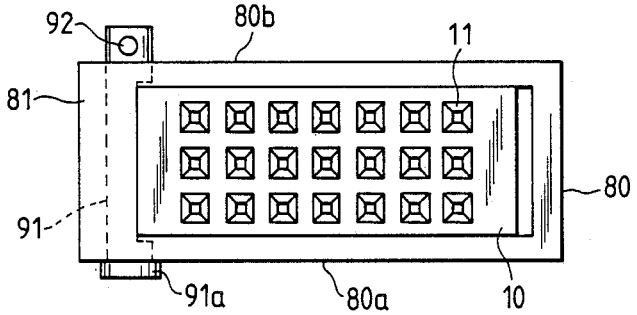
FIGS. 12A and 12B are diagrams showing the entire structure of the connector depicted in FIGS. 9A and 9B.
Figure 12B:
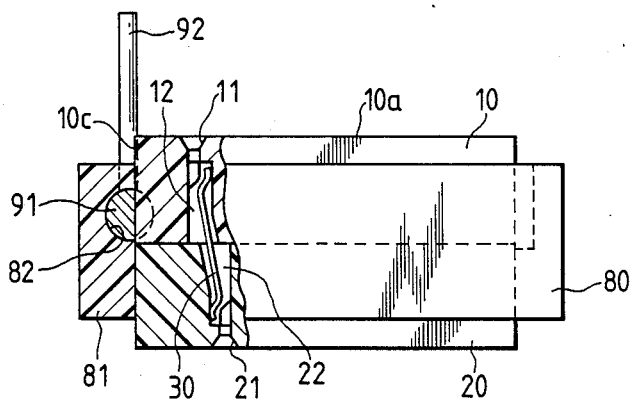

FIGS. 12A and 12B show the whole structure of an example of the connector constructed as described above. Since this example is identical in construction and operation with the example of FIGS. 7A to 7D except the socket contactor 30 and the contact chambers 12 and 22 for housing it, no detailed description will be repeated.

Figure 13A:
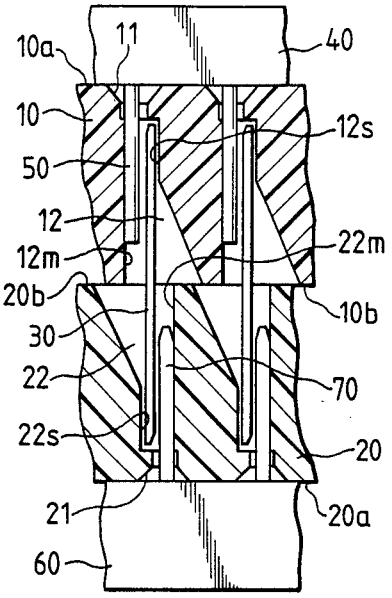
FIGS. 13A and 13B are sectional views illustrating the principal part of another embodiment of the present invention.
Figure 13B:
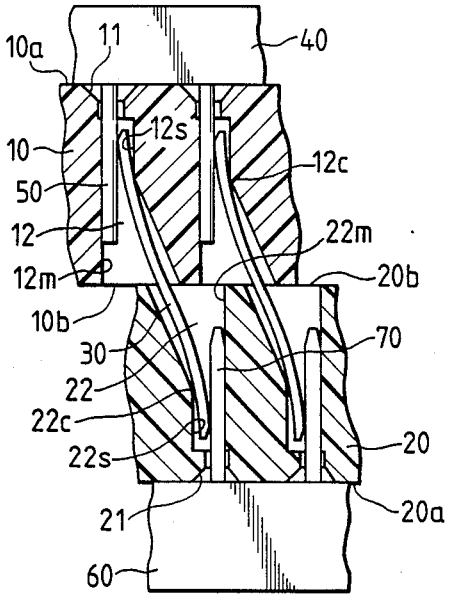

FIGS. 13A and 13B illustrate the principal part of another embodiment of the connector according to the present invention which is also applied to an IC socket.

In this embodiment the socket contactor 30 is flat and the width of the upper portion of the contact chamber 12 near the first wall surface 12*m* in the direction perpendicular to that in which the first and second wall surfaces 12*m* and 12*s* face each other and the width of the lower portion of the contact chamber 22 near the first wall surface 22*m* in the same direction as mentioned above are a little greater than the width of the socket contactor 30 accordingly. The socket contactor 30 is housed in the connector with its upper end portion held on the second wall surface 12*s* of the contact chamber 12 and the lower end portion held on the second wall surface 22*s* of the contact chamber 22. The pin conductor 70 is guided along the first wall surface 22*m* of the contact chamber 22 and held between it and the lower end portion of the socket contactor 30. The terminal pin 50 is guided along the first wall surface 12*m* of the contact chamber 12 and held between it and the upper end portion of the socket contactor 30.

After the pin conductors 70 and the terminal pins 50 have thus been inserted into the connector, the top housing 10 is slid on the bottom housing 20 in a direction from the second wall surface 12*s* to the first wall surface 12*m* of the contact chamber 12 of the top housing 10, that is, in a direction reverse from that in the embodiment depicted in FIGS. 9A to 9D. By this, the socket contactor 30 is tilted as shown in FIG. 13B, and consequently, the upper end portion of the socket contactor 30 presses at a point near its tip the terminal pin 50 against the first wall surface 12*m*, the lower end portion presses at a point near its tip the pin conductor 70 against the first wall surface 22*m*, the upper end portion contacts at a point near its center a shoulder 12*c* of the second wall surface 12*s*, and the lower end portion contacts at a point near its center a shoulder 22c of the second wall surface 22s. In this fashion, the terminal pin 50 is connected to the pin conductor 70 through the socket contactor 30.

In this case, the relationship between the distances l and L, referred to previously with respect to FIG. 11, becomes $l > L$, which is reverse from the relationship in the embodiment depicted in FIGS. 9A to 9D, and the contact pressure P and the force W bear such a relationship as follows:

$$W = F - P = \left(\frac{l}{L} - 1\right)P \tag{6}$$

Also in this instance, by setting the ratio l/L to a value close to 1, the force W can be made appreciably smaller than the contact pressure P and the terminal pin 50 can be connected, by a small force, to the pin conductor 70 through the socket contactor 30 with a predetermined contact pressure.

Figure 14A:
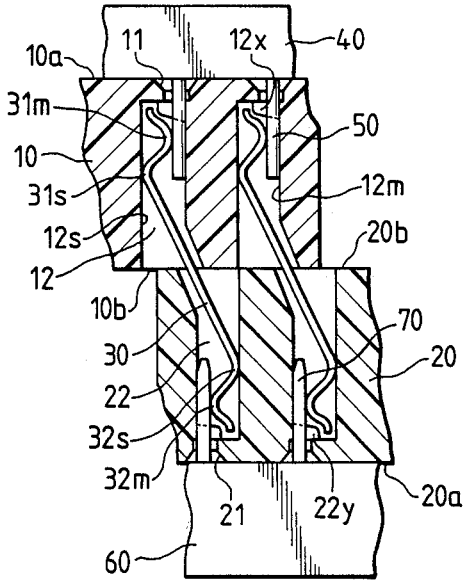
FIGS. 14A and 14B are sectional views illustrating the principal part of another embodiment of the present invention.
Figure 14B:
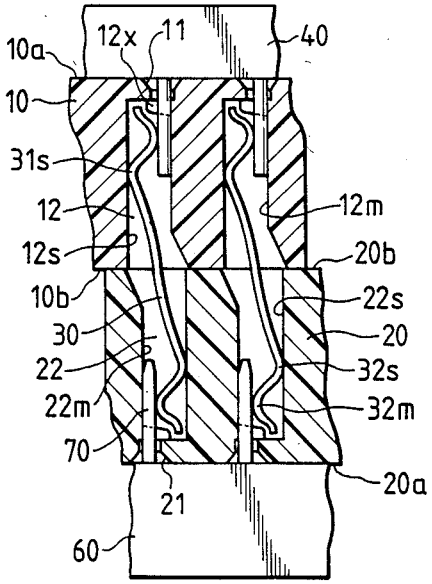

FIGS. 14A and 14B illustrate a modified form of the embodiment shown in FIGS. 9A to 9D, in which the pin contact portions 31m and 32m of the socket contactor 30 are closer to its tips than the wall surface contact portions 31s and 32s, respectively. Consequently, the first and second wall surfaces 12m and 12s of the top housing 10 and the first and second wall surfaces 22m and 22s of the bottom housing 20 are opposite in position from those in the embodiment depicted in FIGS. 9A to 9D. Since this embodiment is identical in the other respects and in operation with the embodiment of FIG. 9, no further detailed description will be given.

Figure 15A:
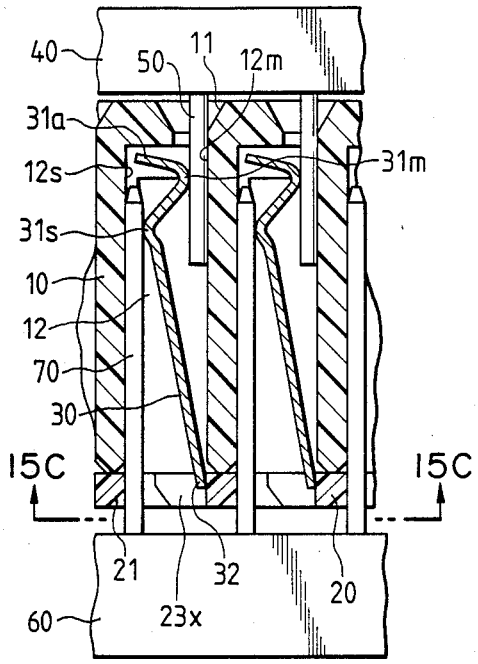
FIGS. 15A, 15B and 15C are sectional views illustrating the principal part of still another embodiment of the present invention.
Figure 15B:
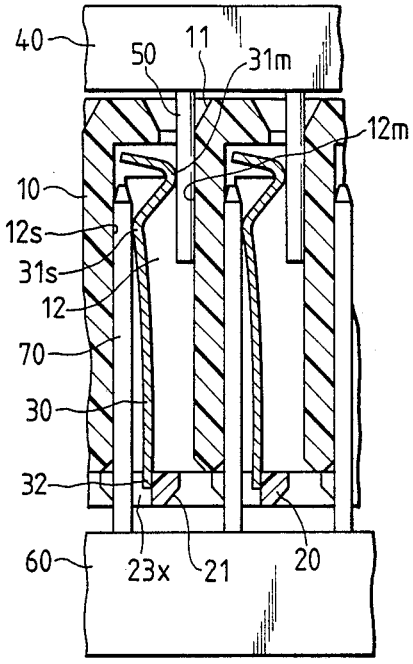
Figure 15C:
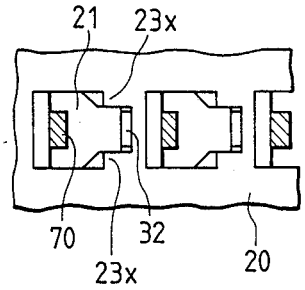

FIGS. 15A, 15B and 15C illustrate a modified form of the embodiment shown in FIGS. 3A to 3F, in which the bottom housing 20 in the above-mentioned embodiment is formed as a plate-shaped cover, which is slidably held against the underside of the top housing 10. The cover 20 has made therein the same pin insertion holes 21 as those shown in FIG. 3F, and the protrusion 23x is provided at one end of each hole 21 for receiving the lower end 32 of the socket contactor 30 as is the case with FIG. 3F. It is evident that, by sliding the cover 20 relative to the top housing 10, the terminal pin 50 and the pin conductor 70 can be connected through the socket contactor 30 or disconnected from each other and removed from the connector as in the embodiment of FIG. 3.

As described above, according to the present invention, since the terminal pin and the pin conductor can be connected, by small force, through the socket contactor with a predetermined pressure, and since the socket contactor can be made relatively flat and narrow, the space needed for interconnecting the terminal pin and the pin conductor through the socket contactor can be made small, the connector of the present invention is suitable for use with an element which has a large number of terminal pins provided with a high density. Furthermore, there is no possibility of the terminal pin and the pin conductor being bent when they are connected to each other.

It will be apparent that many modifications and variations may be effected without departing from the scope of the novel concepts of the present invention.

What is claimed is:

1. A connector comprising:

a top housing having arrays of first pin insertion holes made in its upper panel and arrays of first housing chambers formed therein, each first housing chamber extending from the corresponding first pin insertion hole to the lower panel of the top housing and having a first wall surface with which a terminal pin inserted thereinto through the corresponding first pin insertion hole makes contact in its lengthwise direction and a second wall surface opposite the first wall surface;

a bottom housing disposed with its upper panel held in contact with the lower panel of the top housing and slidable relative thereto, the bottom housing having arrays of second pin insertion holes made in its lower panel and arrays of second housing chambers formed therein, each second housing chamber extending from the corresponding second pin insertion hole to the upper panel of the bottom housing;

narrow, strip-shaped resilient metal socket contactors, each extending across and housed in each pair of first and second housing chambers;

means for holding the top and bottom housings together so that they are slidable relative to each other; and drive means for sliding the top and bottom housings relative to each other.

2. The connector of claim 1, wherein one end portion of each socket contactor housed in the corresponding first housing chamber is substantially S-shaped and includes a first curved portion adjacent the first wall surface of the first housing chamber and a second curved portion adjacent the second wall surface of the first housing chamber.

3. The connector of claim 2, wherein engaging means for supporting the other end portion of each socket contactor is provided near the second pin insertion hole of the corresponding second housing chamber.

4. The connector of claim 1, 2 or 3, wherein each second pin insertion hole is longer than the distance of the relative sliding movement of the top and bottom housings in the direction of the sliding movement and permits a pin conductor inserted into the second pin insertion hole to slide relative to the bottom housing when the top and bottom housing slide relative to each other.

5. The connector of claim 1, wherein each second housing chamber has a first wall surface with which a pin conductor inserted thereinto through the corresponding pin insertion hole make contact in its lengthwise direction and a second wall surface opposite the first wall surface.

6. The connector of claim 5, wherein one end portion of each socket contactor housed in the corresponding first housing chamber is substantially S-shaped portion and includes a first curved portion adjacent the first wall surface of the first housing chamber and a second curved portion making contact with the second wall surface of the first housing chamber, and the other end portion of the socket contactor housed in the corresponding second housing chamber is substantially S-shaped and includes a third curved portion adjacent the first wall surface of the second housing chamber and a fourth curved portion making contact with the second wall surface of the second housing chamber.

7. The connector of claim 1, wherein each first pin insertion hole is formed so that part of its inner peripheral wall is contiguous to the first wall surface of the corresponding first housing chamber.

8. The connector of claim 8, wherein each second pin insertion hole is formed so that a part of its inner peripheral wall is contiguous to the first wall surface of the corresponding second housing chamber.

9. The connector of claim 5, wherein each socket contactor is flat and the second wall surface of each first housing chamber has a first edge for contact with a first intermediate portion of the socket contactor when the top and bottom housings are slid relative to each other.

10. The connector of claim 9, wherein the second wall surface of each second housing chamber has a second edge for contact with a second intermediate portion of the socket contactor when the top and bottom housings are slid relative to each other.

11. A connector comprising:

a housing having arrays of first pin insertion holes made in its upper panel and arrays of housing chambers formed therein, each housing chamber extending from the corresponding first pin insertion hole to the lower panel of the housing and having a first wall surface with which a terminal pin inserted thereinto through the corresponding first pin insertion hole makes contact in its lengthwise direction and a second wall surface opposite the first wall surface;

a cover plate held in contact with the lower panel of the housing but slidable relative thereto and having arrays of second pin insertion holes, the cover plate having an engaging recess adjacent each second pin insertion hole;

narrow, strip-shaped metal socket contactors respectively housed in the housing chambers and engaged at one end with the engaging recess;

means for holding the housing and the cover plate together so that they are slidable relative to each other; and drive means for sliding the housing and the cover plate relative to each other.

* * * * *